US008122529B2

(12) United States Patent
Steggert

(10) Patent No.: US 8,122,529 B2
(45) Date of Patent: Feb. 28, 2012

(54) CUSHIONED BATH LOUNGER

(76) Inventor: Peter F. Steggert, Buford, GA (US)

( * ) Notice: Subject to any disclaimer, the term of this patent is extended or adjusted under 35 U.S.C. 154(b) by 1226 days.

(21) Appl. No.: 11/829,103

(22) Filed: Jul. 27, 2007

(65) Prior Publication Data

US 2009/0025138 A1 Jan. 29, 2009

(51) Int. Cl.
*A47K 3/024* (2006.01)

(52) U.S. Cl. ..... 4/573.1

(58) Field of Classification Search ..... 4/573.1, 4/559, 571.1, 572.1, 574.1, 575.1, 576.1, 4/577.1, 547–548, 579–585; 482/23
See application file for complete search history.

(56) References Cited

U.S. PATENT DOCUMENTS 2,604,637 A * 7/1952 Moore ..... 4/575.1
2,724,839 A * 11/1955 Kennedy ..... 4/551
3,005,208 A * 10/1961 Matthews ..... 4/574.1
6,572,570 B1 * 6/2003 Burns et al. ..... 601/148
7,665,159 B2 * 2/2010 Fowkes ..... 4/581
2002/0120983 A1 * 9/2002 Gonzalez ..... 4/580
* cited by examiner

*Primary Examiner* — Lori Baker
(74) *Attorney, Agent, or Firm* — Gardner Groff Greenwald & Villanueva

(57) ABSTRACT

A cushioned bath lounger adapted for use in a bathtub, or spa, and positioned proximate to the back surface of the bathtub. The cushioned bath lounger presenting a resting place for the head and shoulders of a reclined bather. The lounger having first and second support rails anchored to each side of the bathtub. A flexible support member is positioned between and attached to each support rail. The flexible support member has a first chamber with a visco-elastic pad positioned within to support the bathers head. The flexible support member may also include a second chamber configured to be inflated by air. The air filled second chamber then provides gentle floatation support to the reclined bather when immersed in a bath. The flexible support of the lounger may be adjustably positioned between the support rails and locked in place. The lounger may also be configured such that the flexible support may glide freely along the support rails to provide a rocking motion to the reclined bather.

18 Claims, 10 Drawing Sheets

CUSHIONED BATH LOUNGER

BACKGROUND OF THE INVENTION

1. Field of the Invention

The present invention generally relates to bath devices and more particularly pertains to a bath cushion presenting a resting place for a reclined bather in a bath or spa.

2. Description of the Related Art

Bathing is a basic requirement of personal hygiene, but it may also serve as a luxurious break from the stresses of life, as a therapy from athletic or accidental injury, or simply as a treat. A person may simply wish to soak in a common household tub for an extended period of time. Conventional bath tubs, hot tubs, and saunas are not well suited for the comfort of bather who enjoys an extended stay. The hard interior surfaces of enamel or fiberglass work against the soothing nature of the experience. The bather may not comfortably recline and relax in a partially filled tub, as the bather may slide down into the water, or the back and head support offered by the enclosure may not be properly positioned, or padded. Moreover, the bathing experience fails to take full advantage of the buoyancy support available from the water.

The use of bath tub lounging devices is known in the art. Many different lounger configurations have been presented. However, prior art lounging devices are lacking in separate head and torso support methodology, and do not utilize modern padding materials in their construction. Many prior art devices are permanently affixed to the bath enclosure, and are accordingly not readily adjustable in angle or position, and are not easily removable from the enclosure. Many of the prior art devices fail to provide any floatation support to the bather, and fail to adequately support the head of the bather. Finally, prior art devices fail to offer a selection of lounger positions, an adjustable firmness of support, and fail to offer free movement of the lounger within the bath enclosure. The soothing feeling of floating within the bath water cannot be achieved with a fixed position lounger.

Accordingly, it would be advantageous to provide a device wherein the position of the back and head support are easily adjustable within the bath enclosure, and easily adjustable to accommodate various size bathers. Such device a device would provide the bather with gentle padded flotation support for the torso, and comfortable support for the bathers head. It would also be advantageous to provide a section of positions for the back and neck support, such that a reclined bather may readily change between them. It would also be advantageous if the back and neck support could glide freely with the reclined bather. Such a device would provide adjustable flotation support to the bather, while gently supporting the bathers torso and head, and would allow the lounger support to slide freely with any fore and aft motion of the bather. It is thus to such a cushioned bath lounger that the present invention is primarily directed.

SUMMARY OF THE INVENTION

The disadvantages of the prior art are overcome by the present invention which, in one aspect, is a cushioned bath lounger, the lounger being adapted for use in a bathtub, the bathtub having an upper surface, and inner surfaces, the inner surfaces having a back surface, a bottom surface, a left side surface, and a right side surface, the lounger being positioned proximate to the back surface of the bathtub, the lounger then presenting a resting place for the head and shoulders of a reclined bather.

In another aspect of the present invention, the lounger has a flexible support member with a first chamber therein. A first support rail positioned adjacent at least one inner surface of the bathtub. A first anchoring means connected to the first support rail for anchoring the first support rail to the bathtub. A second support rail positioned adjacent at least one inner surface of the bathtub. A second anchoring means connected to the second support rail for anchoring the second support rail to the bathtub. The flexible support member is affixed to the first support rail by a first attachment means and is affixed to the second support rail by a second attachment means. The flexible support member is suspended between the first support rail and the second support rail.

In another aspect of the present invention, a visco-elastic pad being positioned within the first chamber of the flexible support member. The first chamber of the flexible support member may be vented to the atmosphere. The flexible support member has a second chamber therein. The second chamber may be configured to be inflated by air. The flexible support member may also be made of a vinyl material.

In yet another aspect of the present invention, the cushioned bath lounger first anchoring means and the second anchoring means has at least one suction cup affixed to the first support rail and at least one suction cup affixed to the second support rail. The first anchoring means and the second anchoring means may also have a portion of the first support rail and a portion of the second support rail resting on the bathtub bottom surface. The first anchoring means and the second anchoring means may also have a portion of the first support rail and a portion of the second support rail resting on the bathtub upper surface. The first attachment means having a first handle member affixed to the flexible support member and engaging the first support rail, and the second attachment means having a second handle member affixed to the flexible support member and engaging the second support rail.

In yet another aspect of the present invention, the first support rail has a first elongated slot therein configured to receive the first attachment means, and the second support rail has a second elongated slot therein configured to receive the second attachment means. The first attachment means is positioned within the first elongated slot and slideably engages the first support rail. The second attachment means is positioned within the second elongated slot and slideably engages the second support rail. And the position of the flexible member is slideably adjustable relative to the first and second support rails.

In yet another aspect of the present invention, the first elongated slot in the first support rail has at least one aperture therein configured to receive the first attachment means, and the second elongated slot in the second support rail has at least one aperture therein configured to receive the second attachment means. The first attachment means is positioned within and captured by the at least one aperture of the first support rail. The second attachment means is positioned within and captured by the at least one aperture in the second support rail. And the position of the flexible support member is selectably adjustable relative to the first and second support rails.

In yet another aspect of the present invention, a bath lounger is adapted for use in a bathtub. The bathtub has an upper surface, and inner surfaces. The inner surfaces having a back surface, a bottom surface, a left side surface, and a right side surface. The lounger is positioned proximate to the back surface of the bathtub. The lounger then presents a resting place for the head and shoulders of a reclined bather. The lounger has a flexible support member with a first chamber therein. A first support rail positioned adjacent at least one inner surface of the bathtub. A first anchoring means connected to the first support rail for anchoring the first support rail to the bathtub. A second support rail positioned adjacent at least one inner surface of the bathtub. A second anchoring means connected to the second support rail for anchoring the second support rail to the bathtub.

The flexible support member is affixed to the first support rail by a first attachment means, and the flexible support member is affixed to the second support rail by a second attachment means. The flexible support member is then suspended between the first support rail and the second support rail. A visco-elastic pad is positioned within the first chamber of the flexible support member. The first support rail has a first elongated slot therein configured to receive the first attachment means, the second support rail having a second elongated slot therein configured to receive the second attachment means. Wherein the first attachment means is positioned within the first elongated slot and slideably engages the first support rail, and the second attachment means is positioned within the second elongated slot and slideably engages the second support rail. And the position of the flexible support member is slideably adjustable relative to the first and second support rails.

In yet another aspect of the present invention, the first attachment means having a first handle member affixed to the flexible support member and engaging the first support rail, and the second attachment means having a second handle member affixed to the flexible support member and engaging the second support rail. The flexible support member has a second chamber therein. The second chamber is configured to be inflated by air.

In yet another aspect of the present invention, the first anchoring means and the second anchoring means have at least one suction cup affixed to the first support rail and at least one suction cup affixed to the second support rail. The first anchoring means and the second anchoring means have a portion of the first support rail and a portion of the second support rail resting on the bathtub bottom surface. The first anchoring means and the second anchoring means have a portion of the first support rail and a portion of the second support rail resting on the bathtub upper surface.

In yet another aspect of the present invention, the first elongated slot in the first support rail has at least one aperture therein configured to receive the first attachment means, and the second elongated slot in the second support rail has at least one aperture therein configured to receive the second attachment means. The first attachment means is positioned within and captured by the at least one aperture of the first support rail. The second attachment means being positioned within and captured the at least one aperture in the second support rail. And the position of the flexible support member is selectably adjustable relative to the first and second support rails.

In yet another aspect of the present invention, a bath lounger is adapted for use in a bathtub. The bathtub has an upper surface, and inner surfaces, the inner surfaces having a back surface, a bottom surface, a left side surface, and a right side surface. The lounger is positioned proximate to the back surface of the bathtub. The lounger then presents a resting place for the head and shoulders of a reclined bather. The lounger has a flexible support member with a first and a second chamber therein. A first support rail positioned adjacent at least one inner surface of the bathtub. A first anchoring means connected to the first support rail for anchoring the first support rail to the bathtub. A second support rail positioned adjacent at least one inner surface of the bathtub. A second anchoring means connected to the second support rail for anchoring the second support rail to the bathtub. The flexible support member is affixed to the first support rail by a first attachment means, and the flexible support member is affixed to the second support rail by a second attachment means. The flexible support member is then suspended between the first support rail and the second support rail.

The bath lounger also has a visco-elastic pad positioned within the first chamber of the flexible support member. The second chamber of the flexible support member is configured to be inflated by air. The first support rail has a first elongated slot therein configured to receive the first attachment means, the second support rail has a second elongated slot therein configured to receive the second attachment means. The first attachment means is positioned within the first elongated slot and slideably engages the first support rail, and the second attachment means is positioned within the second elongated slot and slideably engages the second support rail. And the position of the flexible support member is slideably adjustable relative to the first and second support rails.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

A bath lounger provides a means to cushion the body of a bather when lounging in a bath. Prior art bath lounging devices provide a means to cushion the body, but are not easily installed within the bath, are not easily adjustable, do not allow infinite adjustment, and do not allow any gliding motion of the bather. Prior art devices also do not incorporate different padding methodology at the head and torso of the bather to optimize the comfort of the device.

Figure 1:
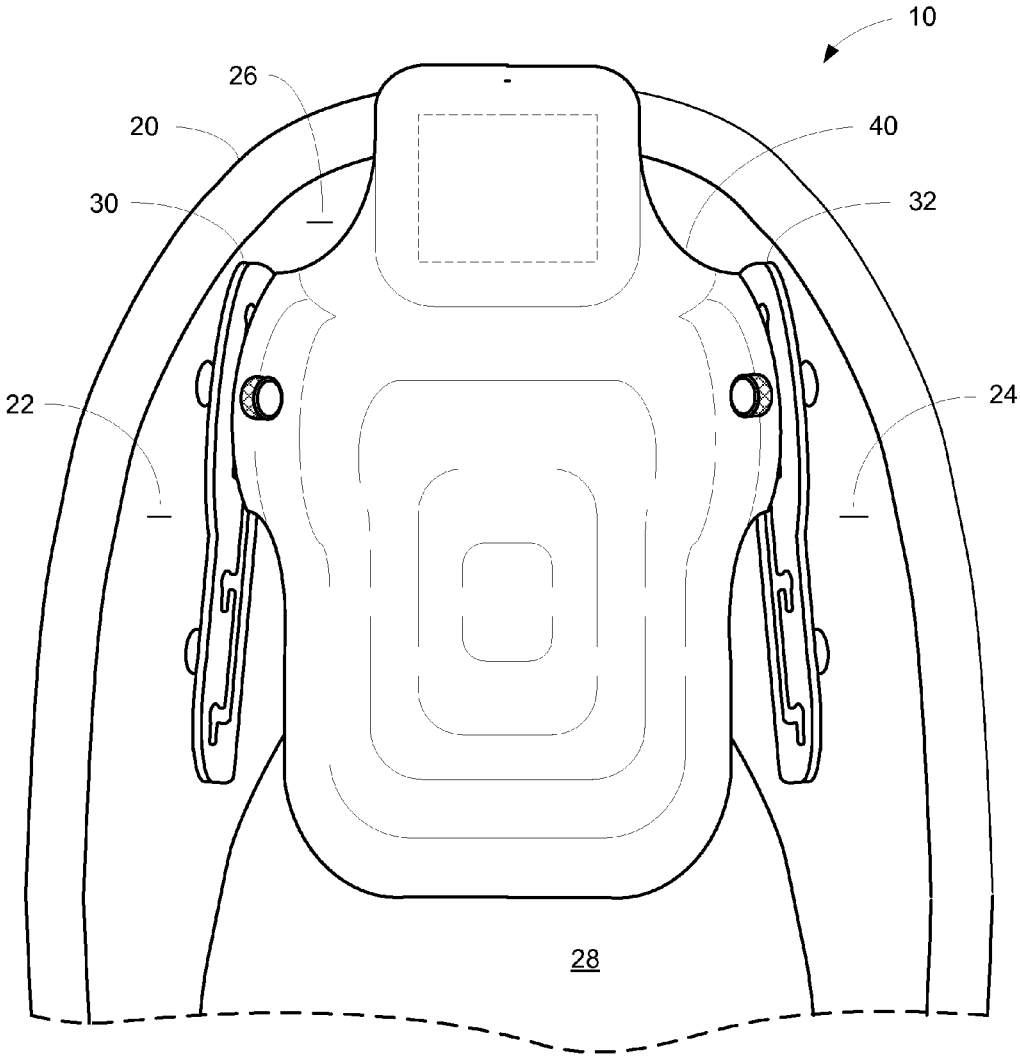
FIG. 1 is a front-perspective view of the bath lounger device positioned within a bath enclosure.

With reference to the figures in which like numerals represent like elements throughout, FIG. 1 is a front view of one embodiment of the cushioned bath lounger 10 of the present invention positioned within a bath 20. In FIG. 1, the lounger 10 includes rails 30, 32 which are affixed to the inner left and right inner faces 22, 24 of the bath 20. A flexible support 40 extends between the two rails 30, 32 and is affixed to each rail. The flexible support 40 partially rests on the back inner face 26, and bottom 28 of the bath 20. The flexible support 40 may also be positioned above the bath bottom 28, and may also be suspended between the side rails 30, 32 and spaced away from, and not in contact with, the bath back inner face 26.

Figure 2:
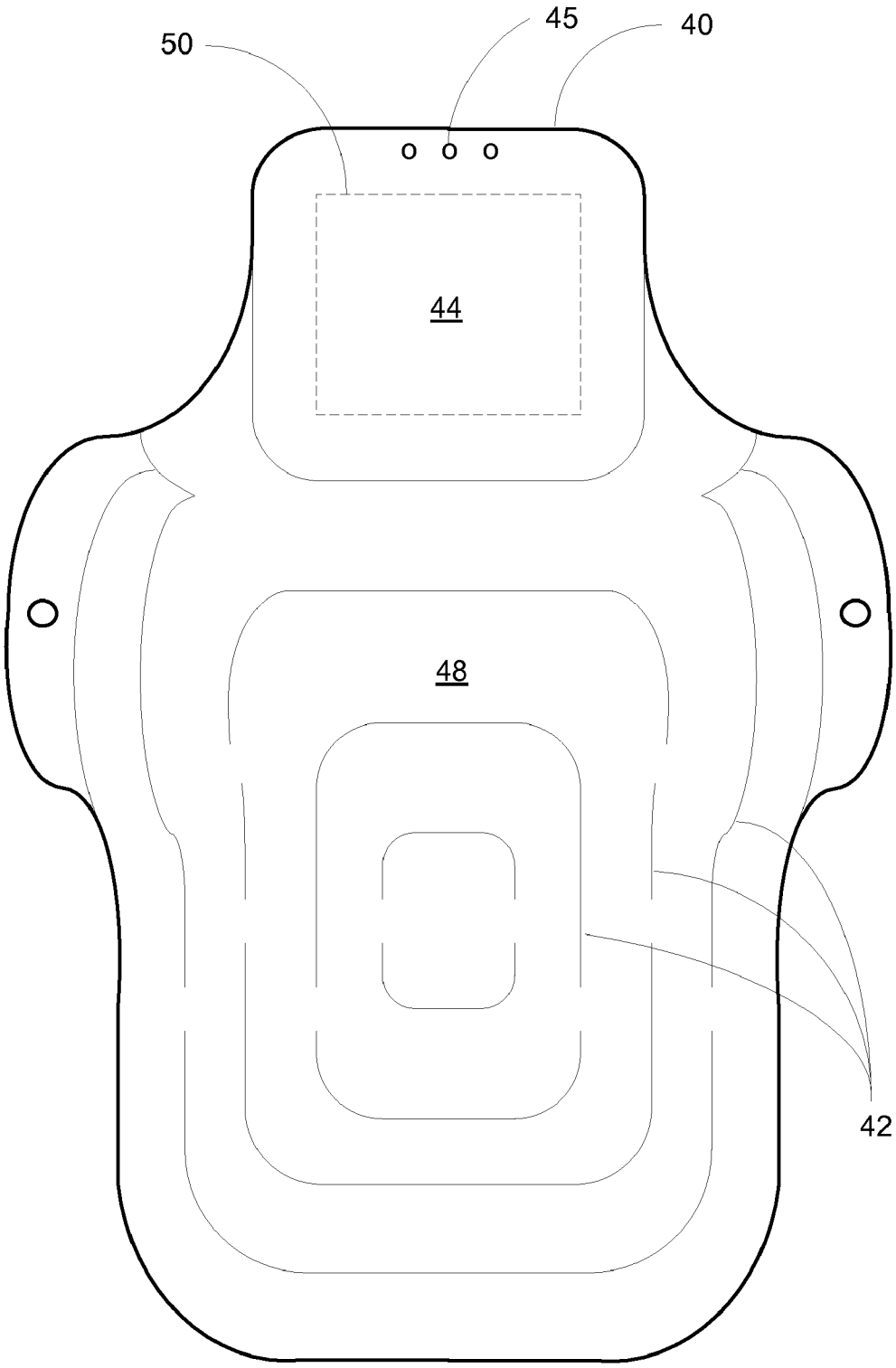
FIG. 2 is a front view of flexible member component of the bath lounger of FIG. 1.

As shown in FIG. 2, the flexible support 40 includes a first upper chamber 44 and a second lower chamber 48. The upper chamber encloses a pad 50 for cushioning the head of the bather. The lower chamber 48 is configured to be inflated by air to cushion the back and shoulders of a reclined bather. In one embodiment of the present invention, the flexible support may be made of a vinyl material such as 21 mil pvc sheet with applied flocking, but any water and air impermeable, flexible and durable material may be used such as nylon, polyesters, and other types of plastic, natural or synthetic rubber, treated fabric compositions, or other material as are well known to those skilled in the art.

The lower chamber 48 is configured to be inflated by air and is divided into a number of interconnected compartments by ribs 42 molded into the flexible support 40. The ribs 42 control the shape and distribution of air within the inflated lower chamber 48. The air pressure within the lower chamber 48 may be adjusted to accommodate the support preference of individual bathers. For example, the lower chamber 48 may be only partially inflated to accommodate a child using the device, whereas the chamber may be fully inflated to accommodate an older adult desiring full padding and support when lounging on the device 10.

As further shown in FIG. 2, a pad 50 is positioned within the upper chamber 44 to cushion the head of a reclined bather. The upper chamber 44 is vented to the atmosphere to allow air to escape as a bather positions his head upon and compresses the upper portion of the flexible support. The venting of the upper chamber is accomplished via small perforations 45 in the uppermost portion of the chamber. The perforations 45 allow air to escape from the chamber, but do not readily allow the entry and entrapment of water within the upper chamber 44. In an alternative embodiment of the present invention, the upper chamber 44 may be sealed water tight by a flap and closure, or may be permanently sealed closed after insertion of the pad 50 by welding, bonding or other means as are known to those skilled in the art.

The pad 50 is preferably made of a visco-elastic foam, which are also known in the art as a memory foam. In contrast to conventional foam or other padding material, the visco-elastic foam pad 50 slowly and automatically adjusts to the shape of the head of the bather. The foam is both pressure and temperature sensitive and will gradually conform to an object placed upon it. Under sustained pressure and exposure to body warmth, visco-elastic foam softens and "flows" conforming to the body. With the release or shifting or weight, however, the foam constantly and gradually readjusts to the new body position. The slow, conforming elastic of the visco-elastic foam offers complete, stress free support of the head in an optimal position relative to the bather's shoulders and torso.

Although any visco-elastic foam material can be used for the pad 50 in many cases, visco-elastic foam having certain material properties can provide improved performance results. In some embodiments, visco-elastic foam having a density of no less than about 40 kg/m.sup.3 and/or no greater than about 110 kg/m.sup.3 can provide good performance results. In other embodiments, visco-elastic foam having a density of no less than about 50 kg/m.sup.3 and/or no greater than about 90 kg/m.sup.3 can provide good performance results. In still other embodiments, visco-elastic foam having a density of no less than about 55 kg/m.sup.3 and/or no greater than about 65 kg/m.sup.3 can provide good performance results. For example, in one embodiment of the present invention, the pad 50 of the upper chamber 44 can comprise visco-elastic foam having a density of about 60 kg/m.sup.3.

In one embodiment, visco-elastic foam having a hardness of no less than about 30 N and no greater than about 80 N can provide good performance results. In other embodiments, visco-elastic foam having a hardness of no less than about 35 N and/or no greater than about 75 N can provide good performance results. In still other embodiments, visco-elastic foam having a hardness of no less than about 45 N and/or no greater than about 65 N can provide good performance results. For example, in one embodiment of the present invention, the pad 50 of the upper chamber 44 can comprise visco-elastic foam having a hardness of approximately 55 N.

As further depicted in FIGS. 1 and 2, the dual chamber design of the flexible support 40 allows the optimal choice of support means for the environment. The lower chamber 48 is often immersed in water during use. The lower chamber 48 is constructive of a water and air impermeable fabric and configured to be inflated by air. The air pressure within the lower chamber 48 may be adjusted to accommodate the weight and support preferences of the bather. An inflated lower chamber 48 will provide both a cushion support to the torso of the bather, and also provide a buoyancy support when the lower chamber is immersed, or partially immersed, in the bath water. The upper chamber contains the visco-elastic pad 50, and is configured to be vented to the atmosphere. The venting allows full advantage of the cushioning properties of the visco-elastic pad 50, while the water impermeable fabric of the upper chamber 44 protects the pad from exposure to the moisture of the bath environment.

Figure 3:
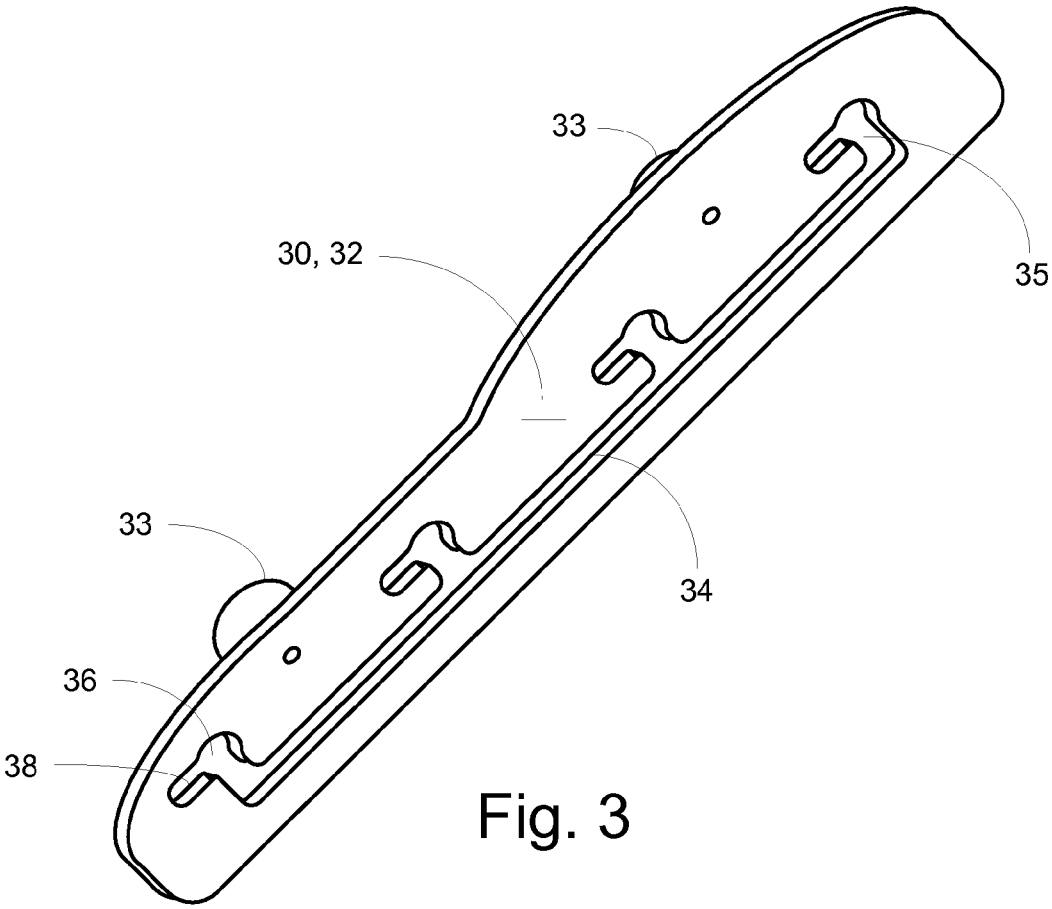
FIG. 3 is a side-perspective view of a side rail component of the bath lounger of FIG. 1.

As show in FIG. 3, the rails 30, 32 are elongate and planar. The left rail 30, and right rail 32 are identical in shape. Means of anchoring the rails to the side walls of the bath enclosure are on opposing sides of the left rail 30 and right rail 32, and in one embodiment of the present invention, include suction cups 33. In addition, means of slideably attaching the flexible support 40 to the first and second rails 30, 32 are provided. In the depicted embodiment, the attachment means are provided by slot-and-handle assemblies. Each rail 30, 32 has an opening or slot 34 extending longitudinally down the rail, and has apertures 35 extending from and connected to slot 34. Each aperture 35 has a bulbous portion 36 and has short slot 38. The short slot 38 of each aperture 35 extends longitudinally down the rail 30, 32. With the exception of the bulbous portion 36, the width of the slots 34, 38 and apertures 35 are the same. In one embodiment of the present invention, the rails may be constructed a durable material such as acrylic, but may also be constructed from injection molded plastics, nylons, or other materials as are know to those skilled in the art.

Figure 4:
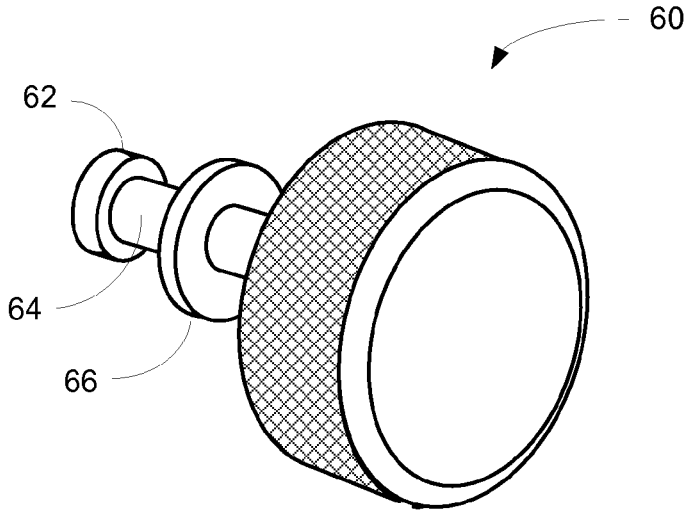
FIG. 4 is a side-perspective view of the handle component of the bath lounger of FIG. 1.

As shown in FIG. 4, a handle 60 is configured to engage the slots 34, 38 in each rail 30, 32. The handle passes through and is permanently affixed to the flexible member 40. The handle 60 has a shaft with varying diameters. The first diameter 62 is at the end of the shaft and is smaller than the width of bulbous portion 36 of the rails 30, 32, but larger than the width of the slots 34, 38. The second diameter 64 is smaller than the width of the slots 34, 38 in the rails 30, 32 and may slide freely within the slot. The third diameter 66 is larger than both the slots 34, 38 and the bulbous portion 36, and limits the insertion of the handle into the rails 30, 32.

Figure 5:
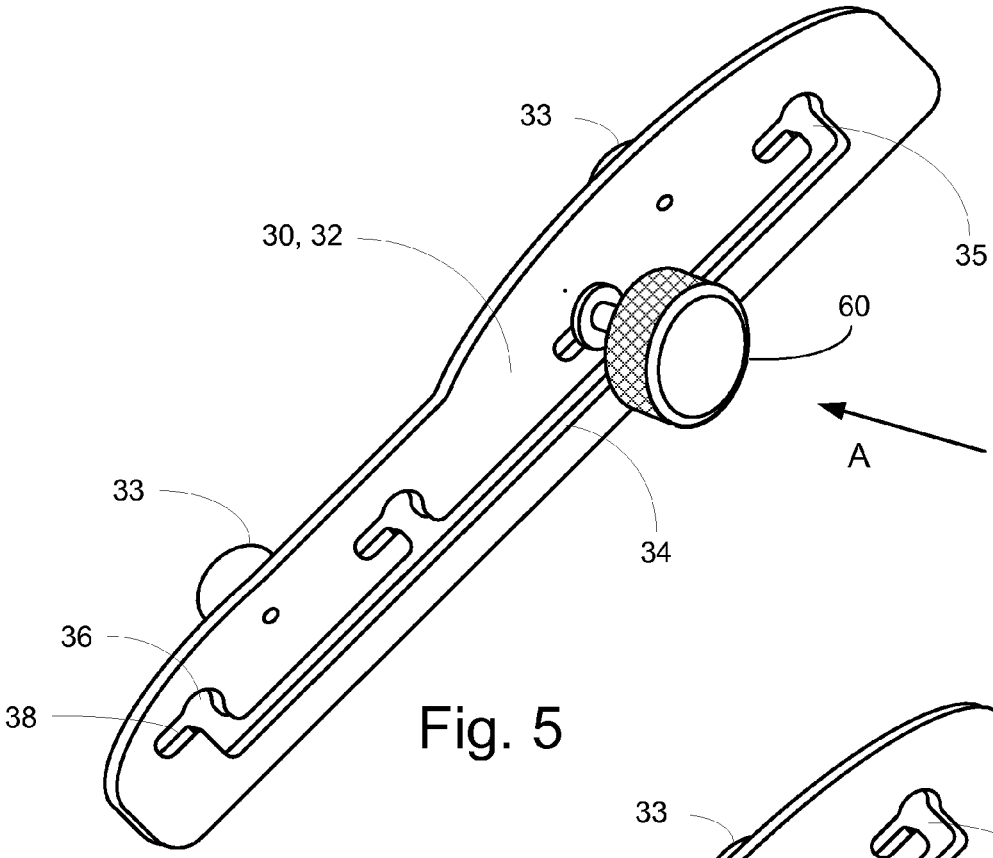
FIG. 5 is a side-perspective view of a side rail component of FIG. 3, illustrating the insertion of the handle component of FIG. 4.
Figure 6:
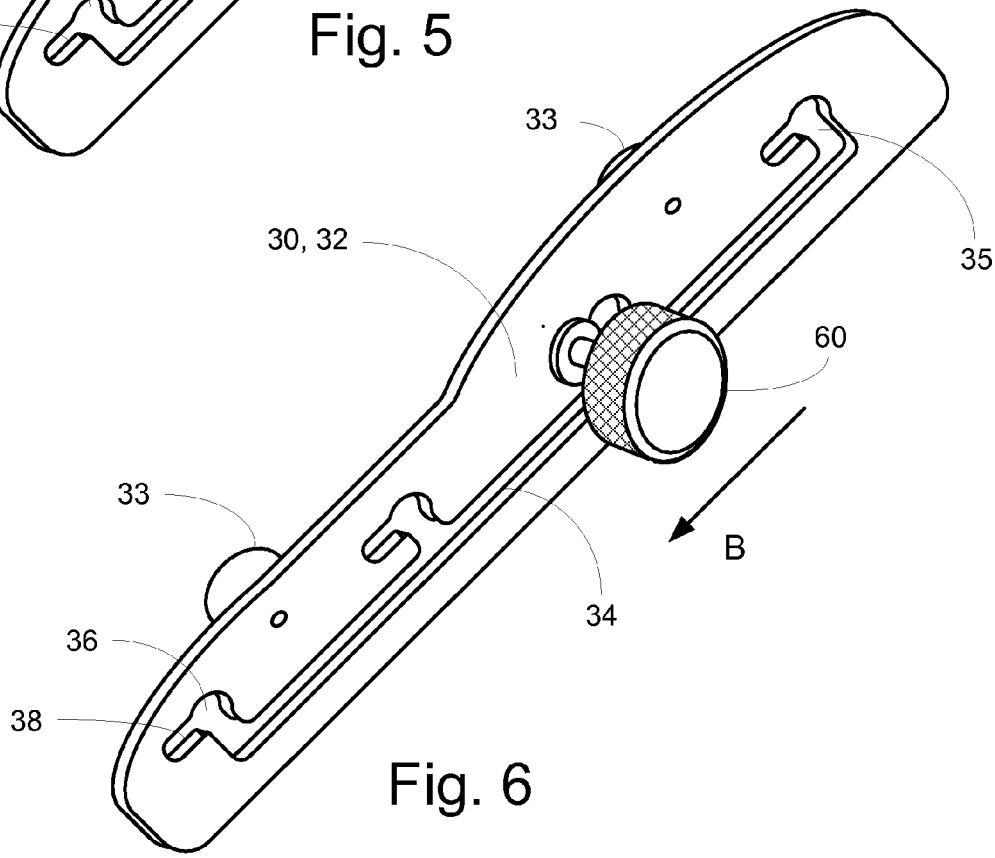
FIG. 6 is a side-perspective view of a side rail component of FIG. 3, with the handle of FIG. 4 inserted within, and illustrating one possible position of the handle component of FIG. 4.
Figure 7:
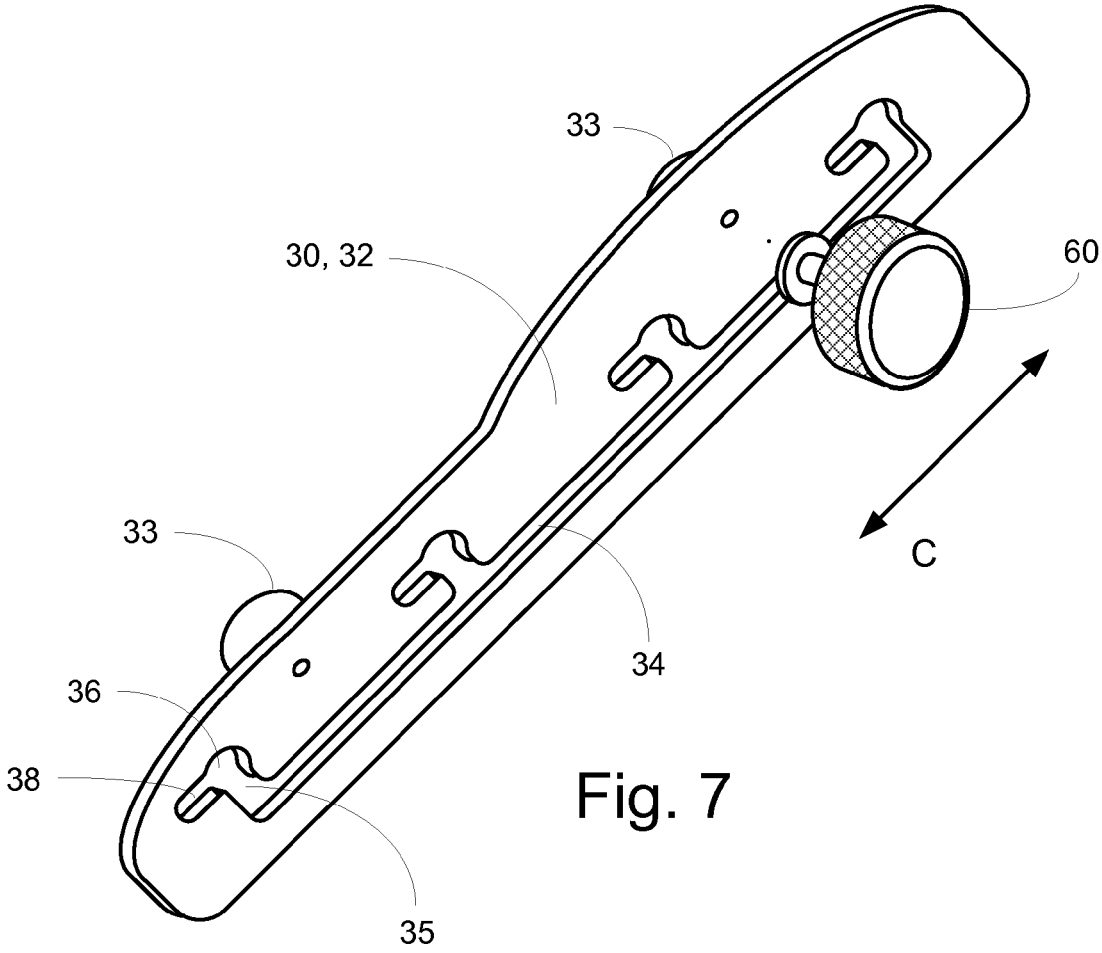
FIG. 7 is a side-perspective view of a side rail component of FIG. 3, with the handle of FIG. 4 inserted within, and illustrating another possible motion of the handle component of FIG. 4.

As depicted in FIGS. 5 and 6, the handle 60 may be inserted into the bulbous portion 36 of an aperture 35 in the direction of arrow A. The first and second diameters 62, 64 pass through the bulbous portion 36 until the third diameter 66 rests on the face of the rail 30, 32. The handle 60 may then be slid within the aperture 35 in the direction of arrow B to the end of the short slot 38. The handle 60 is then captured within the aperture 35 by the first diameter 62 and third diameter 66 resting on opposing sides of the side rail 30, 32. As further depicted in FIG. 7, the handle 60 may also be slid down within the aperture 35 and into slot 34. The handle 60 may then slide freely within the slot 34 in the directions of arrows C.

Figure 8:
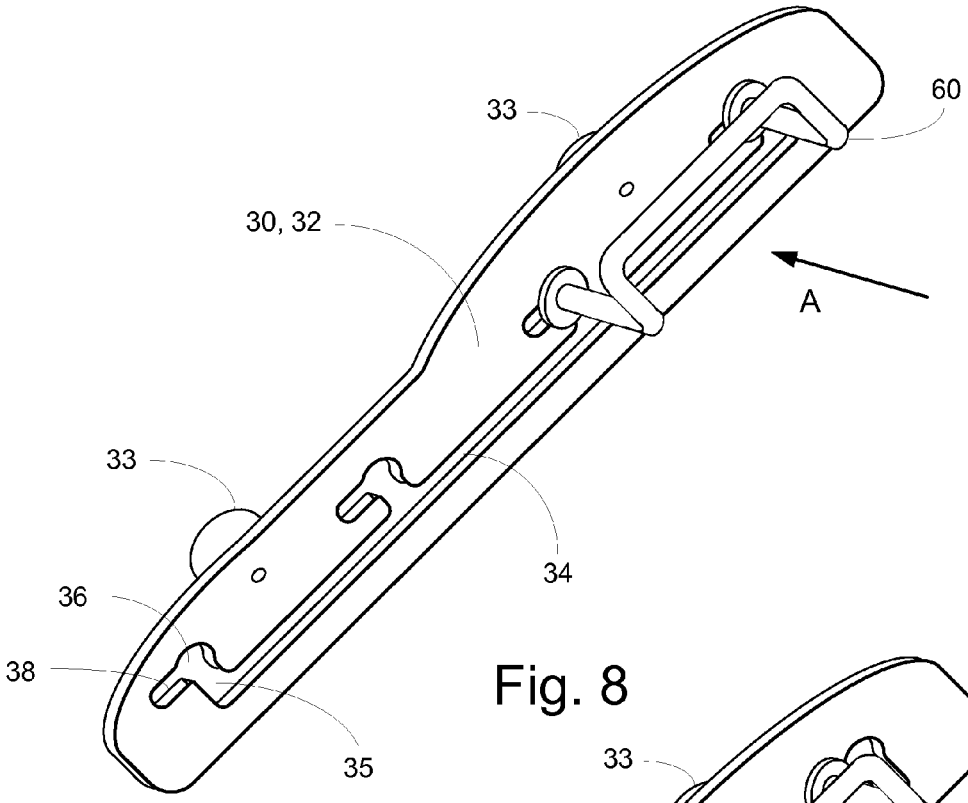
FIG. 8 is a side-perspective view of a side rail component of FIG. 3, illustrating the insertion of an alternative embodiment of the handle component of FIG. 4.
Figure 9:
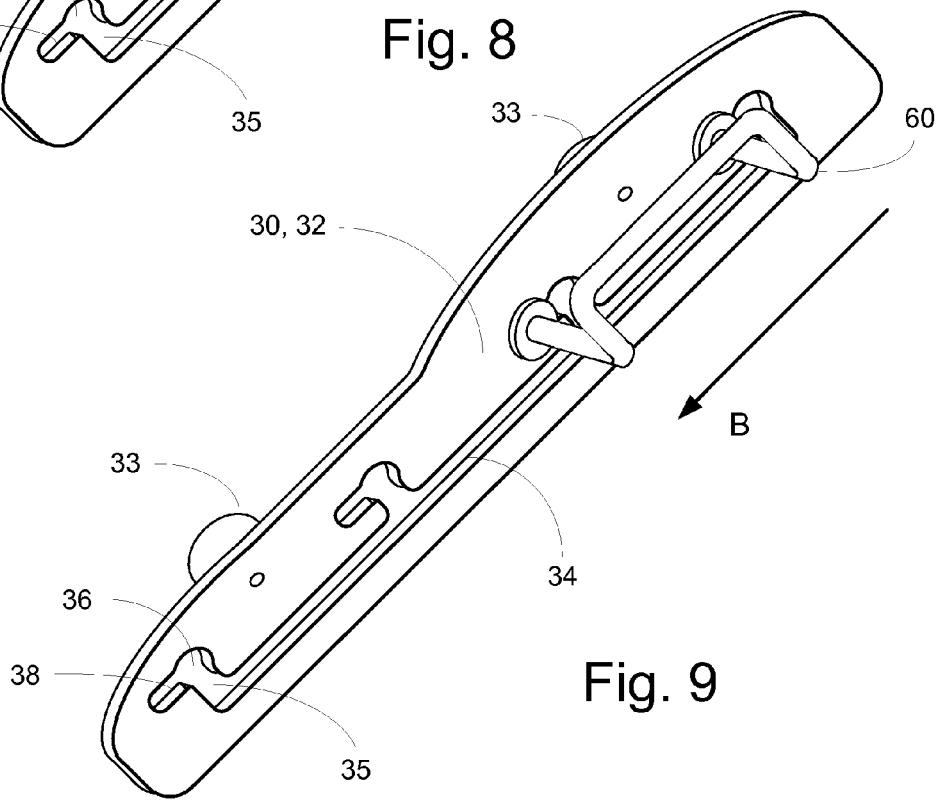
FIG. 9 is a side-perspective view of a side rail component of FIG. 3, with an alternative embodiment of the handle of FIG. 4 inserted within, and illustrating one possible position of the alternative embodiment handle component of FIG. 4.
Figure 10:
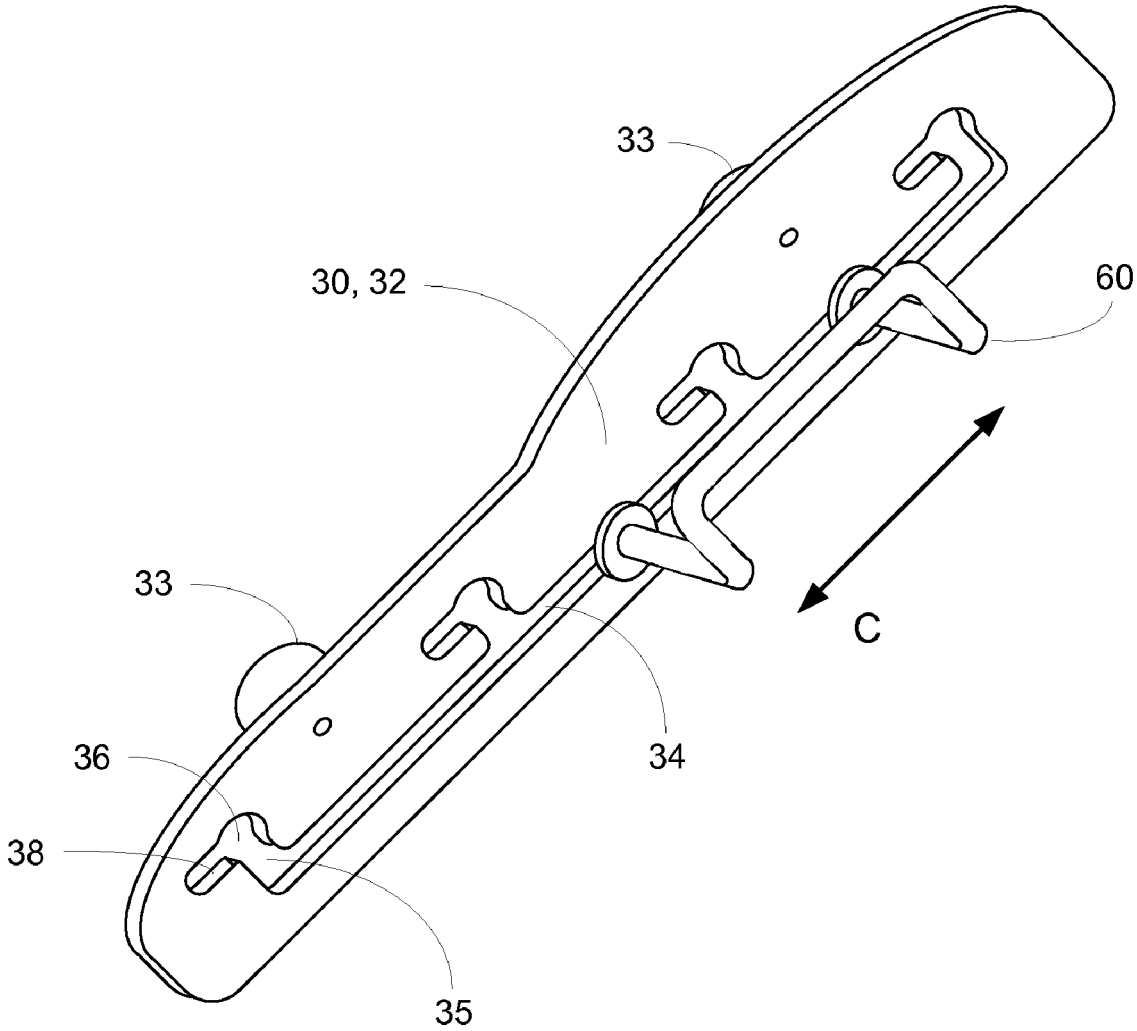
FIG. 10 is a side-perspective view of a side rail component of FIG. 3, with an alternative embodiment of the handle of FIG. 4 inserted within, and illustrating another possible motion of the alternative embodiment handle component of FIG. 4.

An alternative embodiment of the handle 60 of the attachment means of the present invention is shown in FIGS. 8, 9 and 10. As shown in FIG. 8, in this embodiment the handle 60 may extend to engage two apertures 35 at the same time. The handle has two shafts with the same three diameters as the previous embodiment. The handle 60 may then be inserted into the rail 30, 32 in the direction of arrow A. As depicted in FIG. 9, the handle may then be slid within the apertures 35 in the direction of arrow B to the end of the short slots 38. As further depicted in FIG. 10, the handle 60 may also be slid down within the aperture 35 and into slot 34. The handle 60 may then slide freely within the slot 34 along arrows C.

Figure 11:
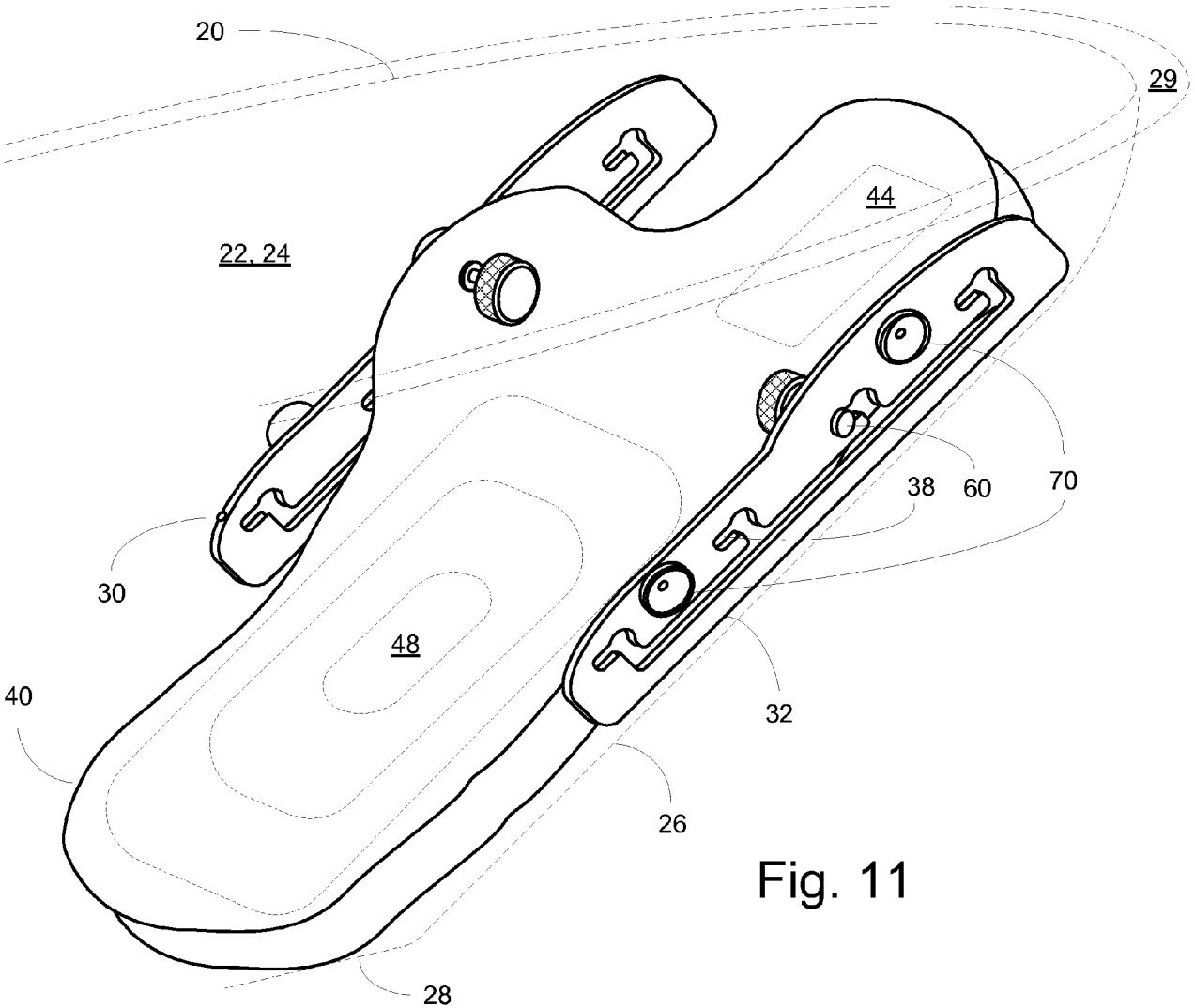
FIG. 11 is side-perspective view of the bath lounger device positioned within a bath enclosure, and illustrated the bath lounger device fixed in a location relative to the bath rails.

The installation of the present invention within a bath enclosure 20 is shown in FIG. 11. The bath enclosure 20 is represented by dashed lines. Each rail 30, 32 is positioned adjacent an inner face 22, 24 of the bath enclosure 20. Each side rail 30, 32 has suction cups 70 affixed to the rail at two locations. The suction cups 70 provide a means to anchor the side rails 30, 32 to the inner face 22, 24 of the bath 20. The use of suction cups 70 allows the rails to anchor to any shape of bath enclosure 20. The flexible suction cups 70 may pivot to engage the bath enclosure inner faces 22, 24 including when the enclosure inner faces are not parallel to the plane of the side rail 30, 32. The flexible member 40 is suspended between rails 30, 32 and may rest on the back inner face 26 of the bath enclosure, or may be suspended off the back inner face 26 of the bath enclosure 20. The flexible member 40 may be further supported by resting on the bottom 28 of the bath enclosure 20, or may rest on the top 29 of the bath enclosure 20, or may be supported by resting on both the top 28 and bottom 29 of the bath enclosure 20. In the configuration depicted in FIG. 11, the flexible member 40 is locked in a stationary position by the handles 60 engaging opposing slots 38. The plurality of apertures 35 allow the bather to select the position of the flexible member 40 relative to the side rails 30, 32 and fix the flexible member in that position by sliding the handle 60 into slots 38. In this manner, the bather may adjust the location of the flexible member 40 and integral pad 44, within the bath enclosure 20 to the most comfortable lounging position.

In alternative embodiments of the present invention, the rails 30, 32 may be further supported by resting on the bottom 28 of the bath enclosure 20, or may rest on the top 29 of the bath enclosure 20, or may be supported by resting on the top 28 and bottom 29 of the bath enclosure 20, with the anchors or anchoring means provided by portions of the rails that support the rails on the bath enclosure. As may be appreciated by one skilled in the art, in other alternative embodiments of the present invention, the rails 30, 32 may be anchored to the side walls of the tub by anchors or anchoring means such as a bonding agent (e.g., an adhesive an adhesive strip), and/or a hook and loop fastener such as VELCRO, or the rails may be formed integral with the bath enclosure 20 with the anchors or anchoring means provided by portions of the rails that extend from the bath enclosure.

Figure 12:
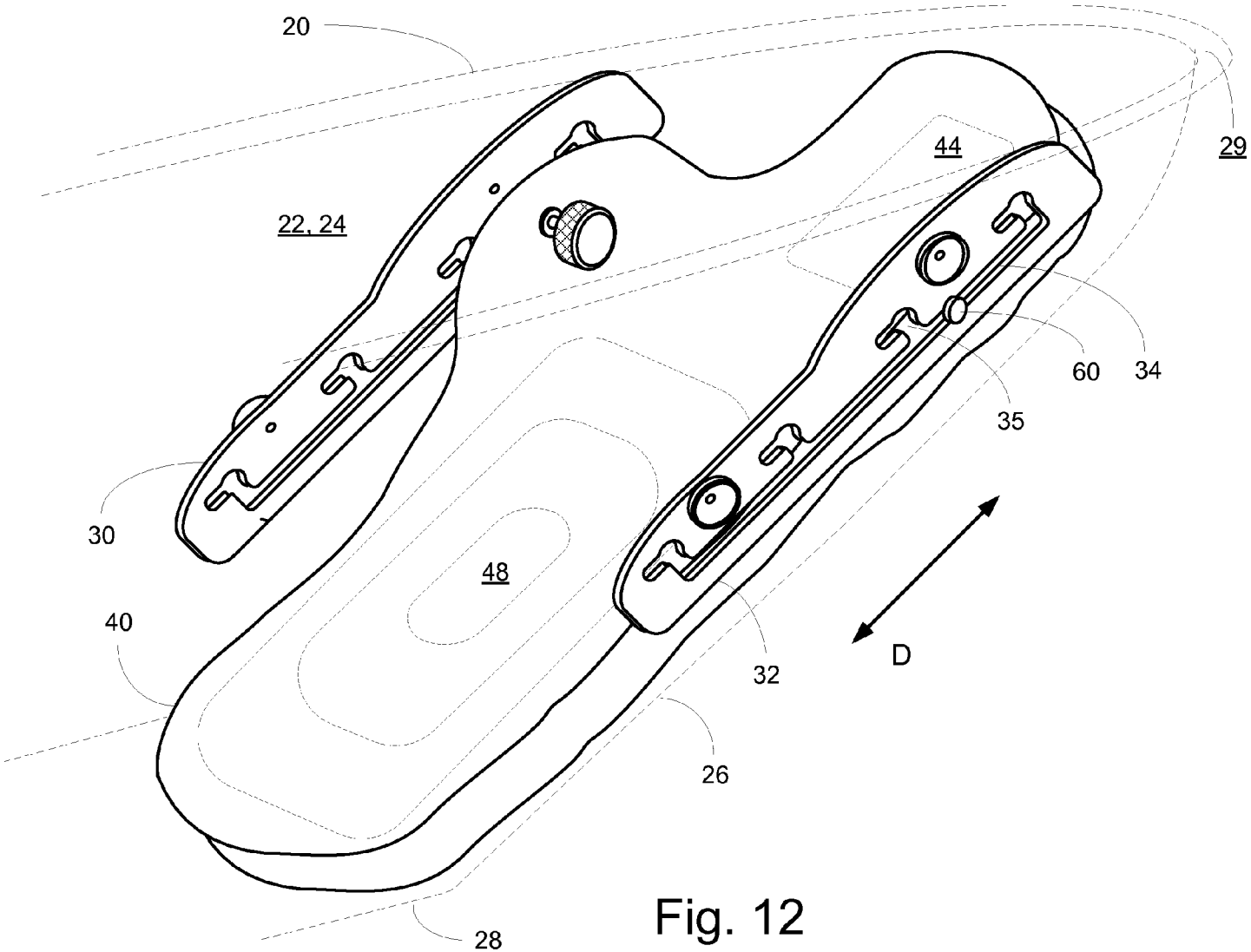
FIG. 12 is side-perspective view of the bath lounger device positioned within a bath enclosure, and illustrated the bath lounger device freely sliding relative to the bath rails.

As depicted in FIG. 12, the flexible member 40 extends between the two rails 30, 32. Depending on the preference of the bather, and the size and shape of the bath 20, the flexible member may rest on the back inner face 26 of the bath enclosure 20, or may be suspended between the rails 30, 32 and not resting on the back inner surface 26 of the bath 20. The flexible member 40 may also extend to rest on the bottom 28, or top 29 of the bath enclosure 20. The handles 60 pass through and engage the flexible member 40. The handles 60 are then inserted into apertures 35 of each support rails 30, 32. In this manner, the flexible member 40 is attached to, and extends between, each rail 30, 32 on opposing sides.

As further depicted in FIG. 12, the handles 60 may be positioned with the slots 34 of the side rails 30, 32. Since the side rails 30, 32 may be positioned on the inner face 22, 24 of the bath enclosure 20 at any convenient angle and height, the bather may choose to place the side rails low within the bath enclosure and at a shallow angle to the bath bottom 28. In this configuration, the torso of the bather may be substantially immersed within the bath water, and the air filled lower chamber 48 will provide a buoyant force to the bathers' torso within the bath water. The buoyant lower chamber 48 thus provides a soothing padded floating support to the bather's torso. The bather may then freely slide the flexible member 40 forward and back, along arrows D, within the bath enclosure 20 to the most comfortable lounging position as the handles 60 freely slide within slots 34. The slots 34 allow the bather to achieve a fore and aft rocking motion while being supported by the flexible member 40 floating within the bath.

Figure 13:
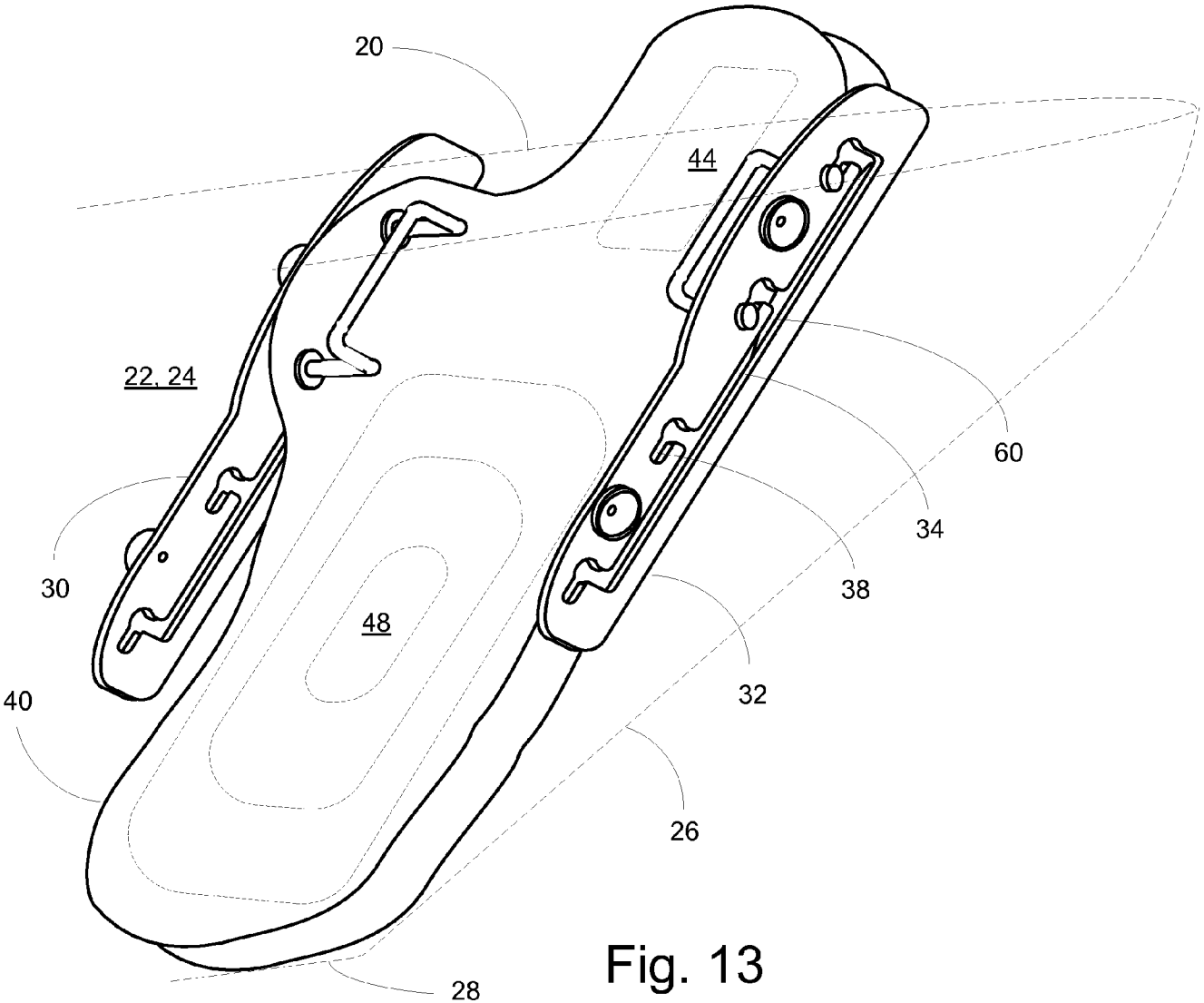
FIG. 13 is side-perspective view of the bath lounger device positioned within a bath enclosure, and illustrated the bath lounger device in a different orientation in the enclosure.

As depicted in FIG. 13, in an alternative configuration, the bather may choose to place the side rails at the rear of the bath 20, on the bath inner faces 22, 24 and at a high angle to the bath bottom 28. The bather may then be seated in an upright position, and the flexible member 40 may travel up and down with the handles 60 traveling in slots 34, to position the padded upper chamber 44 behind the bathers head and with the lower chamber 48 behind the bathers torso, until the most comfortable lounging position is achieved. The handles 60 may then be locked in the appropriate slots 38 at the most comfortable position.

While there has been shown a preferred embodiment of the present invention, it is to be understood that certain changes may be made in the forms and arrangement of the elements of the device without departing from the underlying spirit and scope of the invention.

What is claimed is:

1. A cushioned bath lounger, the lounger being adapted for use in a bathtub, the bathtub having an upper surface, and inner surfaces, the inner surfaces comprising a back surface, a bottom surface, a left side surface, and a right side surface, the lounger being positioned proximate to the back surface of the bathtub, the lounger then presenting a resting place for the head and shoulders of a reclined bather, the lounger comprising:

a flexible support member having a first chamber therein;

a first support rail positioned adjacent at least one inner surface of the bathtub;

a first anchor connected to the first support rail for anchoring the first support rail to the bathtub;

a second support rail positioned adjacent at least one inner surface of the bathtub;

a second anchor connected to the second support rail for anchoring the second support rail to the bathtub;

the flexible support member being affixed to the first support rail by a first attachment, the flexible support member being affixed to the second support rail by a second attachment, the flexible support member being suspended between the first support rail and the second support rail, wherein the first attachment comprises a first handle member affixed to the flexible support member and engaging the first support rail, and the second attachment comprises a second handle member affixed to the flexible support member and engaging the second support rail, wherein the first support rail comprises a first elongated slot therein configured to receive the first handle member, and the second support rail comprises a second elongated slot therein configured to receive the second handle member, the first handle member being positioned within the first elongated slot and slideably engaging the first support rail, the second handle member being positioned within the second elongated slot and slideably engaging the second support rail, and wherein the position of the flexible member is slideably adjustable relative to the first and second support rails; and a visco-elastic pad positioned within the first chamber of the flexible support member.

2. The cushioned bath lounger of claim 1, wherein the first chamber of the flexible support member is vented to the atmosphere.

3. The cushioned bath lounger of claim 1, wherein the flexible support member has a second chamber therein.

4. The cushioned bath lounger of claim 3, wherein the second chamber is configured to be inflated by air.

5. The cushioned bath lounger of claim 1, wherein the flexible support member is made of a vinyl material.

6. The cushioned bath lounger of claim 1, wherein the first anchor and the second anchor comprise at least one suction cup affixed to the first support rail and at least one suction cup affixed to the second support rail.

7. The cushioned bath lounger of claim 1, wherein the first anchor and the second anchor comprise a portion of the first support rail and a portion of the second support rail resting on the bathtub bottom surface.

8. The cushioned bath lounger of claim 1, wherein the first anchor and the second anchor comprise a portion of the first support rail and a portion of the second support rail resting on the bathtub upper surface.

9. The cushioned bath lounger of claim 1, wherein:

the first elongated slot in the first support rail comprises at least one aperture therein configured to receive the first handle member, and the second elongated slot in the second support rail comprises at least one aperture therein configured to receive the second handle member;

the first handle member being positioned within and captured by the at least one aperture of the first support rail;

the second handle member being positioned within and captured by the at least one aperture in the second support rail; and wherein the position of the flexible support member is selectably adjustable relative to the first and second support rails.

10. A bath lounger, the lounger being adapted for use in a bathtub, the bathtub having an upper surface, and inner surfaces, the inner surfaces comprising a back surface, a bottom surface, a left side surface, and a right side surface, the lounger being positioned proximate to the back surface of the bathtub, the lounger then presenting a resting place for the head and shoulders of a reclined bather, the lounger comprising:

a flexible support member having a first chamber therein;

a first support rail positioned adjacent at least one inner surface of the bathtub;

a first means, connected to the first support rail, for anchoring the first support rail to the bathtub;

a second support rail positioned adjacent at least one inner surface of the bathtub;

a second means, connected to the second support rail, for anchoring the second support rail to the bathtub;

a first means for attaching the flexible support member to the first support rail, and a second means for attaching the flexible support member to the second support rail, the flexible support member being suspended between the first support rail and the second support rail;

a visco-elastic pad positioned within the first chamber of the flexible support member;

the first support rail comprising a first elongated slot therein configured to receive the first attachment means, the second support rail comprising a second elongated slot therein configured to receive the second attachment means;

wherein the first attachment means is positioned within the first elongated slot and slideably engages the first support rail, and the second attachment means is positioned within the second elongated slot and slideably engages the second support rail; and wherein the position of the flexible support member is slideably adjustable relative to the first and second support rails.

11. The cushioned bath lounger of claim 10, wherein the first attachment means comprises a first handle member affixed to the flexible support member and engaging the first support rail, and the second attachment means comprises a second handle member affixed to the flexible support member and engaging the second support rail.

12. The cushioned bath lounger of claim 10, wherein the flexible support member has a second chamber therein.

13. The cushioned bath lounger of claim 12, wherein the second chamber is configured to be inflated by air.

14. The cushioned bath lounger of claim 10, wherein the first anchoring means and the second anchoring means comprise at least one suction cup affixed to the first support rail and at least one suction cup affixed to the second support rail.

15. The cushioned bath lounger of claim 10, wherein the first anchoring means and the second anchoring means comprise a portion of the first support rail and a portion of the second support rail resting on the bathtub bottom surface.

16. The cushioned bath lounger of claim 10, wherein the first anchoring means and the second anchoring means comprise a portion of the first support rail and a portion of the second support rail resting on the bathtub upper surface.

17. The cushioned bath lounger of claim 10, wherein:

the first elongated slot in the first support rail comprises at least one aperture therein configured to receive the first attachment means, and the second elongated slot in the second support rail comprises at least one aperture therein configured to receive the second attachment means;

the first attachment means being positioned within and captured by the at least one aperture of the first support rail;

the second attachment means being positioned within and captured the at least one aperture in the second support rail; and wherein the position of the flexible support member is selectably adjustable relative to the first and second support rails.

18. A bath lounger, the lounger being adapted for use in a bathtub, the bathtub having an upper surface, and inner surfaces, the inner surfaces comprising a back surface, a bottom surface, a left side surface, and a right side surface, the lounger being positioned proximate to the back surface of the bathtub, the lounger then presenting a resting place for the head and shoulders of a reclined bather, the lounger comprising:

a flexible support member having a first and a second chamber therein;

a first support rail positioned adjacent at least one inner surface of the bathtub;

a first means, connected to the first support rail, for anchoring the first support rail to the bathtub;

a second support rail positioned adjacent at least one inner surface of the bathtub;

a second means, connected to the second support rail, for anchoring the second support rail to the bathtub;

a first means for attaching the flexible support member to the first support rail, and a second means for attaching the flexible support member to the second support rail, the flexible support member being suspended between the first support rail and the second support rail;

a visco-elastic pad positioned within the first chamber of the flexible support member; the second chamber of the flexible support member being configured to be inflated by air;

the first support rail comprising a first elongated slot therein configured to receive the first attachment means, the second support rail comprising a second elongated slot therein configured to receive the second attachment means;

wherein the first attachment means is positioned within the first elongated slot and slideably engages the first support rail, and the second attachment means is positioned within the second elongated slot and slideably engages the second support rail; and wherein the position of the flexible support member is slideably adjustable relative to the first and second support rails.

* * * * *